US006832872B2

(12) United States Patent
Koelm et al.

(10) Patent No.: US 6,832,872 B2
(45) Date of Patent: Dec. 21, 2004

(54) GAS DISCHARGE DEVICE FOR A CONSTRUCTION VEHICLE

(75) Inventors: Mark D. Koelm, Mattoon, IL (US); Thomas A. Roth, Lerna, IL (US)

(73) Assignee: Blaw-Knox Construction Equipment Corporation, Mattoon, IL (US)

( * ) Notice: Subject to any disclaimer, the term of this patent is extended or adjusted under 35 U.S.C. 154(b) by 64 days.

(21) Appl. No.: 10/293,135

(22) Filed: Nov. 13, 2002

(65) Prior Publication Data

US 2004/0088968 A1 May 13, 2004

(51) Int. Cl.[7] ..... E01C 19/00
(52) U.S. Cl. ..... 404/108; 60/317
(58) Field of Search ..... 404/101, 108, 404/110; 60/272, 315, 317; 181/227

(56) References Cited

U.S. PATENT DOCUMENTS

| | | | | |
|---|---|---|---|---|
| 2,501,767 A | | 3/1950 | Fluor et al. | |
| 2,725,948 A | | 12/1955 | Keene | |
| 3,106,984 A | | 10/1963 | Carter | |
| 3,804,079 A | * | 4/1974 | Schrader | 126/343.5 A |
| 4,012,160 A | * | 3/1977 | Parker | 404/84.05 |
| 4,033,328 A | * | 7/1977 | Lohman et al. | 126/343.5 A |
| 4,360,076 A | | 11/1982 | Suyama | |
| 4,388,804 A | | 6/1983 | Bushmeyer | |
| 4,401,095 A | | 8/1983 | DuLoft | |
| 4,745,988 A | | 5/1988 | Hardt et al. | |
| 5,123,501 A | | 6/1992 | Rothman et al. | |
| 5,170,020 A | | 12/1992 | Kruger et al. | |
| 5,328,209 A | | 7/1994 | Cromwell | |
| 5,443,325 A | | 8/1995 | Simonelli et al. | |
| 5,890,460 A | | 4/1999 | Ball et al. | |
| 5,938,371 A | | 8/1999 | Gustin et al. | |
| 5,951,725 A | * | 9/1999 | Vross et al. | 55/356 |
| 6,079,901 A | | 6/2000 | Banks et al. | |
| 6,152,649 A | * | 11/2000 | Snyder et al. | 404/101 |
| 6,220,387 B1 | | 4/2001 | Hoppes et al. | |

FOREIGN PATENT DOCUMENTS

| | | |
|---|---|---|
| DE | 10200361 | 7/2003 |
| EP | 0526673 | 10/1993 |

* cited by examiner

*Primary Examiner*—Gary S. Hartmann
(74) *Attorney, Agent, or Firm*—Michael Best & Friedrich LLP

(57) ABSTRACT

A device is provided for discharging two gases from a vehicle to ambient air, one gas having pressure pulsation of a first magnitude. The device includes an elongated body connected with the vehicle and having a first inlet connected with a first gas source, a second inlet connected with a second gas source, an outlet fluidly communicable with ambient air, and an interior mixing chamber, the two inlets being fluidly communicable with the chamber such that the two gases flow into the chamber. The body combines the two gases within the mixing chamber to form a combined gas having pressure pulsation of a lesser, second magnitude and to discharge the combined gas to ambient air. Preferably, the body includes an outer tubular member having the first inlet and the outlet and an inner tubular member disposed within the outer member and including the second inlet and a plurality of ports.

14 Claims, 6 Drawing Sheets

GAS DISCHARGE DEVICE FOR A CONSTRUCTION VEHICLE

BACKGROUND OF THE INVENTION

The present invention relates to construction vehicles, and more particularly to devices for discharging gases from construction vehicles.

Construction vehicles, such as paving vehicles, are generally known and typically include an internal combustion engine for powering a drive system. Generally, an exhaust system is provided which includes one or more flow lines, typically pipes, and an exhaust stack located at an appropriate location on the vehicle body such that the exhaust gas flows from the engine through the pipes and out the exhaust stack. Certain exhaust systems include a muffler device disposed within the flow lines to decrease the magnitude or level of pressure pulsation level in the exhaust gas flow so as to reduce the level of sound (i.e., noise) generated by the gas discharged from the exhaust stack.

In addition, certain paving vehicles include a system for removing fumes from the vehicle. A fume removal or "evacuation" system typically includes one or more flow lines (e.g., hoses or pipes) extending from an area(s) within or near the vehicle at which fumes from paving material tend to accumulate to a discharge pipe at an appropriate location on the vehicle. One location where fumes accumulate is the space beneath the vehicle frame where a transfer conveyor deposits material forwardly of a spreading auger. If the fumes were allowed to accumulate within this particular area, a person(s) operating the vehicle screed may be discomforted by breathing such fumes. As such, the evacuation system removes the fumes from such areas within or near the vehicle and discharges the fumes from another location where contact with the vehicle operator(s) is avoided.

SUMMARY OF THE INVENTION

In a first aspect, the present invention is a gas discharge device for discharging first and second gases from a paving vehicle to ambient air. The first gas flows from a first gas source and the second gas flows from a second gas source, the second gas having pressure pulsation of a first magnitude. The discharge device comprises an elongated body connected with the vehicle and having a first inlet fluidly connectable with the first gas source, a second inlet fluidly connectable with the second gas source, an outlet fluidly communicable with ambient air, and an interior mixing chamber. The first and second inlets are each fluidly communicable with the mixing chamber such that the first and second gases flow into the mixing chamber when the first inlet is connected with the first gas source and the second inlet is connected with the second gas source. The body is configured to combine the first and second gases within the mixing chamber so as to form a combined gas having pressure pulsation of a second magnitude substantially lesser than the first pulsation magnitude and to discharge the combined gas through the outlet to ambient air.

In another aspect, the present invention is also a gas discharge device for discharging first and second gases from within a vehicle to ambient air, the second gas having pressure pulsation of a first magnitude. The discharge device comprises a first tubular member having an inner surface bounding an interior space, an inlet fluidly connectable with a source of the first gas and an outlet fluidly communicable with ambient air. A second tubular member is disposed at least partially within the first member interior space and has an inner surface bounding an interior chamber, an inlet extending into the chamber and fluidly connectable with a source of the second gas. The second member also includes an outer surface spaced from and facing generally toward the inner surface of the first member such that the first member inner surface and the second member outer surface define a mixing chamber, and a plurality of ports. Each port extends between the second member inner and outer surfaces so as to fluidly connect the interior chamber and the mixing chamber. As such, when the first gas flows through the first member inlet and the second gas flows through the second member inlet, the two gases combine within the mixing chamber and flow out of the first member outlet as a combined gas. The combined gas has pressure pulsation of a second magnitude, the second pulsation magnitude being substantially lesser than the first pulsation magnitude.

In a further aspect, the present invention is a gas discharge device for discharging paving material fumes and engine exhaust gases from a paving vehicle to ambient air. The vehicle has an engine and a fume removal system, the exhaust gases having a pressure pulsation of a first magnitude. The discharge device comprises a first tubular member having an inner surface bounding an interior space, an inlet fluidly connectable with the fume removal system and an outlet fluidly communicable with ambient air. A second tubular member is disposed at least partially within the first member, the second member having an inner surface bounding an interior chamber, an inlet extending into the interior chamber and fluidly connectable with the engine, an outer surface disposed concentrically within the outer surface of the first tubular member. As such, the first member inner surface and the second member outer surface define an annular mixing chamber. The second member further includes a plurality of ports, each port extending between the inner and outer surfaces of the second member and establishing fluid communication between the second member interior chamber and the mixing chamber such that the exhaust gas flows into the mixing chamber and combines with the fumes to form a combined gas. The combined gas flows through the first member inlet to ambient air and has pressure pulsation of a second magnitude, the second pulsation magnitude being substantially lesser than the first pulsation magnitude.

BRIEF DESCRIPTION OF THE DRAWINGS

The foregoing summary, as well as the detailed description of the preferred embodiments of the invention, will be better understood when read in conjunction with the appended drawings. For the purpose of illustrating the invention, there is shown in the drawings, which are diagrammatic, embodiments that are presently preferred. It should be understood, however, that the invention is not limited to the precise arrangements and instrumentalities shown. In the drawings.

DETAILED DESCRIPTION OF THE INVENTION

Figure 1:
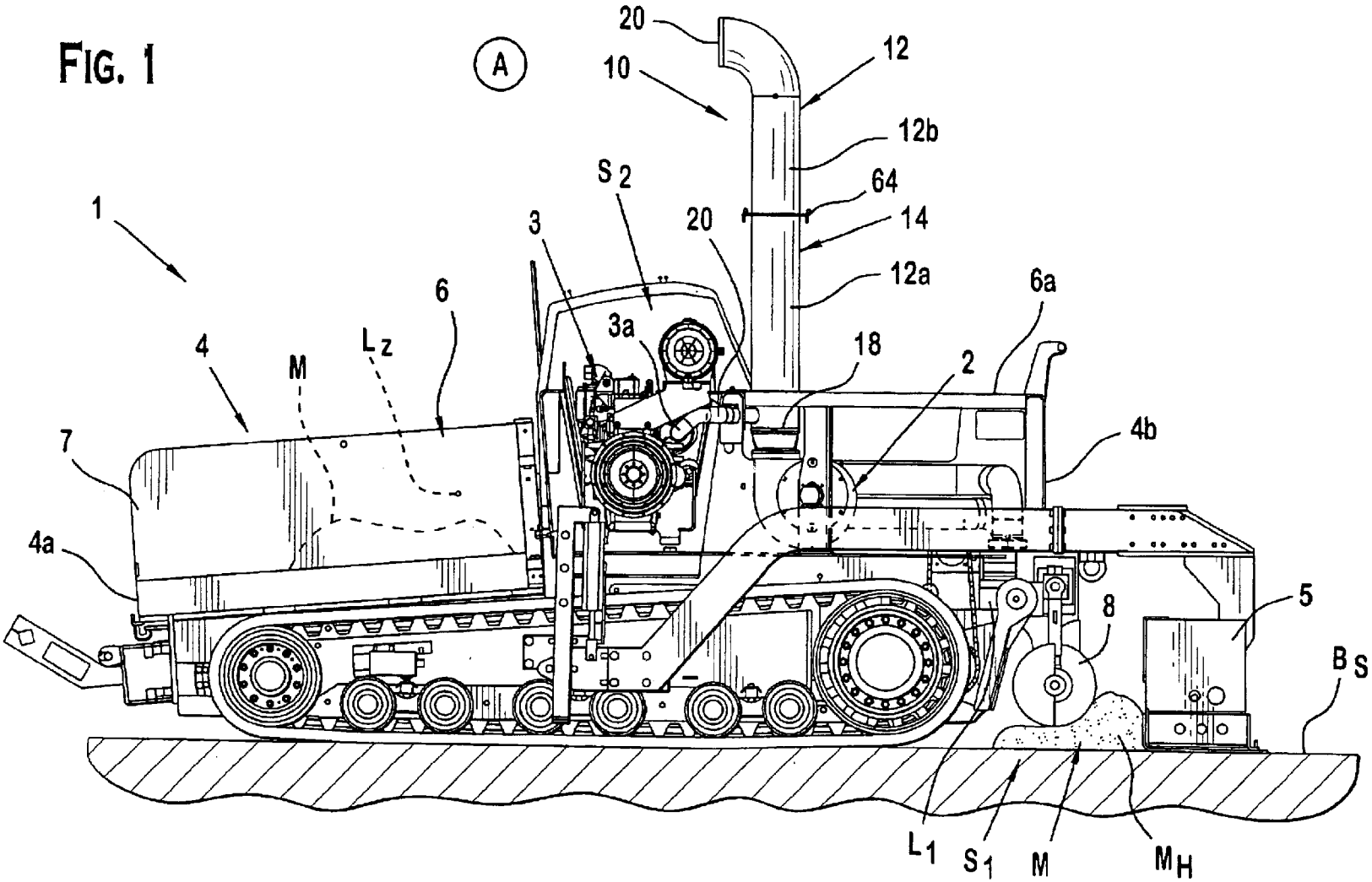
FIG. 1 is a side elevational view of a paver having the gas discharge device of the present invention.

Certain terminology is used in the following description for convenience only and is not limiting. The words "upper", "upwardly" and "lower", "downward", "downwardly" refer to opposing directions within a drawing to which reference is made. The words "inner" "inwardly" and "outer", "outwardly" refer to directions toward and away from, respectively, a designated inner surface or designated center of a discharge device or a component thereof, the particular meaning intended being readily apparent from the context of the description. The terminology includes the words specifically mentioned above, derivatives thereof, and words or similar import.

Referring now to the drawings in detail, wherein like numbers are used to indicate like elements throughout, there is shown in FIGS. 1–6 a presently preferred embodiment of a gas discharge device 10 for discharging first and second gases $G_1$, $G_2$ or gas flows $F_1$, $F_2$, respectively, from a vehicle 1 to ambient air A. The first gas $G_1$ flows from a first gas source $S_1$ and the second gas $G_2$ flows from a second gas source $S_2$ having pressure pulsation of (or at) a first, relatively substantial level or magnitude. The discharge device 10 basically comprises an elongated body 12 connectable with the vehicle 1 and including a first inlet 18 fluidly connectable with the first gas source $S_1$, a second inlet 20 fluidly connectable with the second gas source $S_2$ and an outlet 22 fluidly communicable with ambient air A (i.e., about the vehicle 1). The body 12 also has an interior mixing chamber 24, the respective first and second inlets 18, 20 each being fluidly communicable with the mixing chamber 24, such that the first and second gases $G_1$, $G_2$, respectively, flow into the mixing chamber 24 when the first inlet 18 is connected with the first gas source $S_1$ and the second inlet 20 is connected with the second gas source $S_2$.

Further, the body 12 is configured to mix or combine the first and second gases $G_1$, $G_2$, respectively, within the mixing chamber 24 so as to form a combined gas $G_1+G_2$ or "$G_C$" having pressure pulsation of (or at) a second magnitude/level and to discharge the combined gas $G_C$ through the outlet 22 to ambient air A. The second pulsation magnitude, which may be about zero such that the combined gas $G_C$ has a generally constant pressure, is substantially lesser than the first pulsation magnitude. As such, the sound level generated by discharge of the combined gas Gc to ambient A is substantially lesser than the sound level that would be generated if the second gas $G_2$ was discharged directly from the second gas source $S_2$ to ambient air A. It must be noted that the term "combined" as used herein to describe the combined gas $G_C$ is intended to mean a physical mixture of the two gases $G_1$ and $G_2$ without any chemical reaction between the gases $G_1$, $G_2$, including both heterogeneous and homogeneous mixtures thereof.

Preferably, the body 12 is formed of or includes a first tubular portion or member 14 and a second tubular portion/member 16 disposed at least partially within the first member 12 such that the mixing chamber 24 is defined between the two tubular portions/members 14 and 16. Each of the two tubular members or portions 14 and 16 has a central longitudinal axis 14*a*, 16*a*, respectively, which are preferably generally collinear (see, e.g., FIG. 4). The first or "outer" tubular member 14 preferably has an inner circumferential surface 26 bounding an interior space 23 and includes the first inlet 18 and the outlet 22. The second or "inner" tubular member 16 has an inner surface 30 bounding an interior "transition" chamber 32 and includes the second inlet 20, which extends into the transition chamber 32, and an outer circumferential surface 34. The second member outer circumferential surface 34 is spaced (i.e., radially-inwardly) from and faces generally toward the first member inner circumferential surface 26, such that first member inner surface 26 and the second member outer surface 34 bound an outer circumferential portion of the interior space 23, which provides the mixing chamber 24. Most preferably, the outer circumferential surface 34 of the second member 16 is disposed generally concentrically within the inner circumferential surface 26 of the first tubular member 14, such that the mixing chamber 24 is generally annular and extends completely circumferentially about the inner tubular member 16 (and thus about the transition chamber 32). Further, the second, inner tubular member 16 has a plurality of "injection" ports 36, each port 36 extending radially between the inner and outer surfaces 30, 34, respectively, of the second member 16. Each one of the ports 36 establishes fluid communication between the interior transition chamber 32 and the mixing chamber 24, such that the second gas flow $F_2$ passes through the ports 36 and combines with the first gas flow $F_1$ within the mixing chamber 24.

Preferably, the vehicle 1 includes a fume removal system 2 configured to evacuate paving material fumes from location(s) within the vehicle 1 and/or proximal to the vehicle 1, the removal system 2 providing the first gas source $S_1$ and generating the first gas flow $F_1$. Further, the vehicle 1 also includes an engine 3 having an exhaust flow line 3*a* providing the second gas source $S_2$ and generating the second gas flow $F_2$. Thus, the first gas $G_1$ and gas flow $F_1$ preferably includes paving material fumes mixed with air and the second gas $G_2$/gas flow $F_2$ preferably includes or comprises exhaust gas(es) from the engine 3. As discussed in further detail below, the gas discharge device 10 provides such a vehicle 1 with the benefits of reducing the number of exhaust pipes or stacks on the vehicle 1 and of reducing the sound level that would otherwise be generated by the engine exhaust gas flow $F_2$. Preferably, the first gas $G_1$ flows through the first inlet 18 generally at a first temperature $T_1$ and the second gas $G_2$ flows through the second inlet 20 generally at a second temperature $T_2$ that is substantially greater than the first temperature $T_1$. As such, the combined gas Gc flows from the discharge device 10 to ambient air A generally at a third temperature $T_3$ that is substantially lesser than the second gas flow temperature $T_2$, thereby reducing the thermal energy output that would occur if the second, exhaust gas $G_2$ was discharged directly to ambient air A. Each of the above-discussed basic elements of the gas discharge device 10 is described in further detail below.

Referring particularly to FIG. 1, as discussed above, the gas discharge device 10 is preferably used with a construction vehicle 1 and most preferably with a paving vehicle 1. Alternatively, the discharge device 10 may be used with any other type of construction vehicle 10, such as compacting vehicles, loader vehicles, excavators or mobile drilling machines, or even other vehicles that may benefit from the device 10, for example agricultural tractors (none shown). The preferred paving vehicle 1 includes a tractor 4 and a screed 5 towed from the rear end 4*b* of the tractor 4. The tractor 4 includes a body or frame 6, a hopper 7 disposed at the tractor front end 4*a* and an auger 8 connected with the rear end 4*b* of the tractor 4. Further, a conveyor (not shown) transports paving material M from the hopper 7 to the rear end 4*b* of the tractor 4, where the material M falls from the conveyor and deposits onto the ground or base surface $B_S$ and is spread by the auger 8 so as to accumulate in a material head $M_H$ forwardly of the screed 5. With this arrangement, fumes $G_f$ from the paving material M, particularly with asphalt but also potentially from materials such as superpave, concrete or quickrete, tend to accumulate within the frame 6 at the rear end 4*b* of the tractor 4. In addition, the material fumes $G_f$ may also accumulate within the hopper 7.

Figure 2:
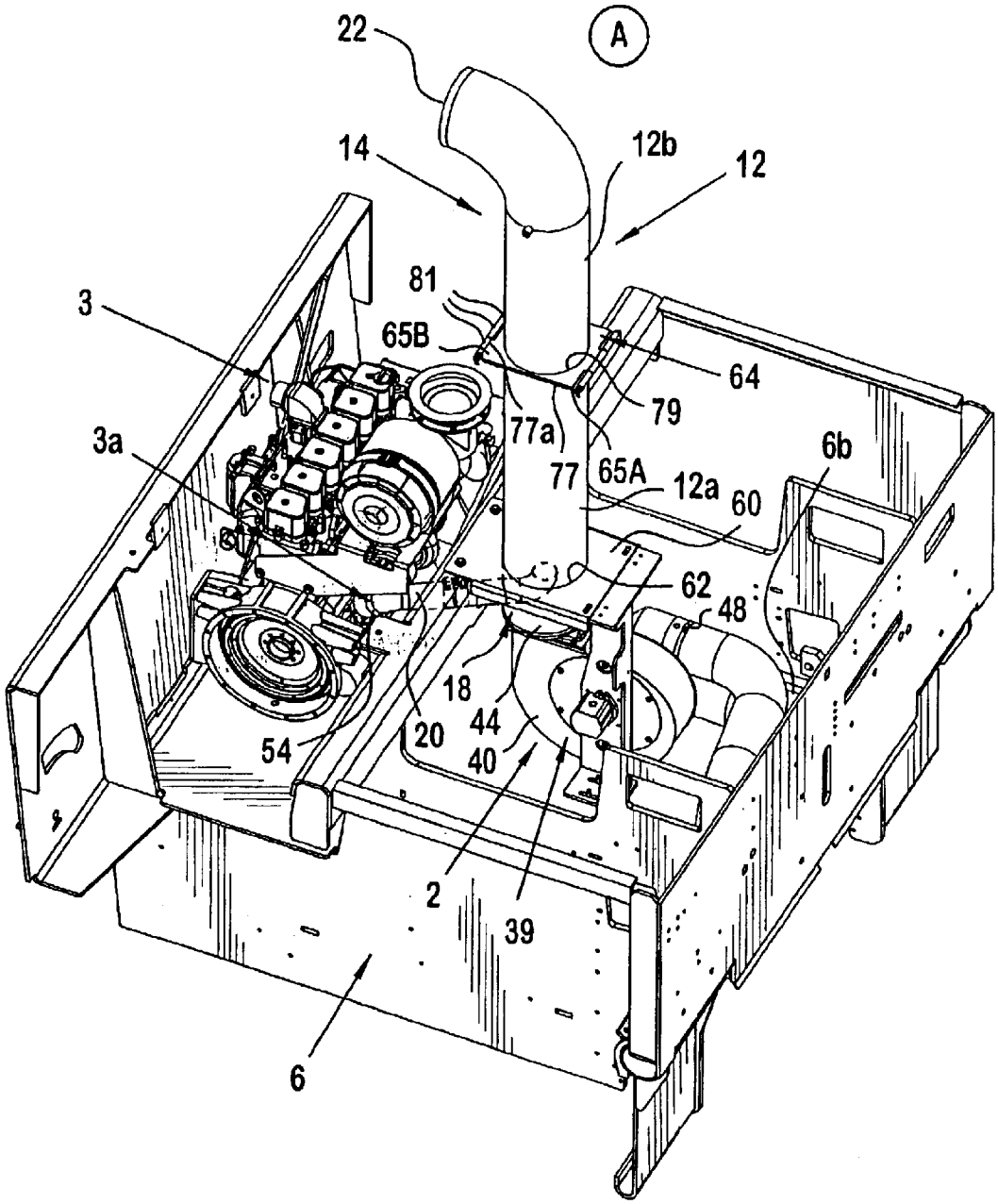
FIG. 2 is a perspective view of the gas discharge device shown connected with both a material fume evacuation system and an engine exhaust line.
Figure 3:
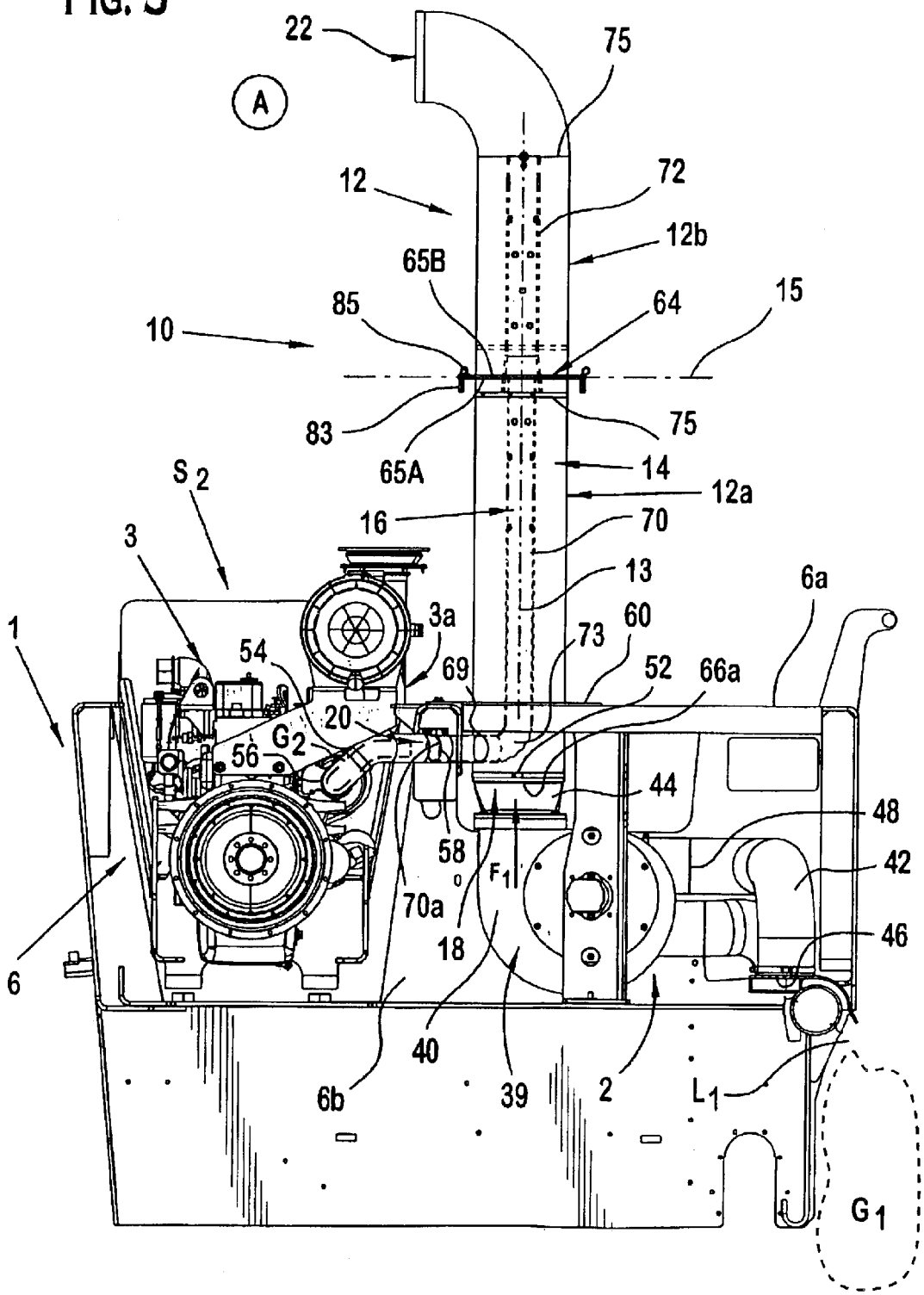
FIG. 3 is a side elevational view of the gas discharge system shown in FIG. 2.

Referring to FIGS. 1–3, the fume removal or evacuation system 2 is configured to remove such material fumes $G_f$ and preferably includes a gas pump 39, preferably a fan or blower 40, and first and second line portions 42, 44, respectively, connected with the blower 40. The first line portion 42 has an inlet 46 disposed at a location $L_1$ at the vehicle rear end 4*b* where the fumes $G_f$ tend to accumulate and an outlet 48 connected with the blower 40. Further, the second line portion 44 has an inlet 50 connected with the blower 40 and an outlet 52 connected with the first inlet 18 of the gas discharge device 10. The fume removal system 2 may alternatively include one or more other line portions (none shown) each having an inlet disposed at another location within the vehicle 1, such as location $L_2$ within the hopper 7, and an outlet connected with the first line portion 42 or directly with the blower 40. With either structure, the blower 40 causes the gas fumes $G_f$ and quantities of surrounding air A to be drawn into the inlet 50, thereby evacuating the fumes $G_f$ from the location $L_1$ (and possibly $L_2$), and pressurizes the fume/air mixture forming the first gas $G_1$. As such, the first gas flow $F_1$ passes through the evacuation system outlet 52 and into the discharge device first inlet 18 at a pressure substantially above ambient air pressure and generally at the first temperature $T_1$, which is preferably lesser than the temperature of the fumes $G_f$ "flowing off" of the relatively hot paving material M.

Further, the engine flow line 3*a* preferably includes a tubular member or pipe 54 having an inlet 56 connected with the engine 3 and an outlet 58 connected with the second inlet 20 of the discharge device 10. The engine 3 "injects" a relatively high pressure flow of exhaust gases $G_2$ into the discharge device 10, the second gas $G_2$ having pressure pulsation at a substantial, relatively high first magnitude. As is well known, the periodic opening and closing of the exhaust valves (not shown) of an engine 3 cause exhaust gases $G_2$ to propagate through the pipe 54 in a pulsating, wave-like gas flow $F_2$ of alternating higher pressure flow portions and lower pressure flow portions (not depicted), the magnitude or amplitude of the pressure pulsation being the average pressure difference between these higher and lower pressure flow portions. The magnitude/amplitude of the pressure pulsation of the gas flow $F_2$ determines the loudness of the sound generated when the gas $G_2$ flows into ambient air A; more specifically, the greater the magnitude/amplitude of pressure pulsation, the greater the sound generated thereby, and vice-versa. Thus, the discharge device 10 functions to reduce the magnitude of pressure pulsation of the second gas $G_2$ prior to discharge (i.e., as part of the combined gas $G_C$) to ambient air A, so as to reduce the sound level that would otherwise be generated thereby.

Although the gas discharge device 10 is preferably used to combine and discharge a first gas $G_1$ consisting of paving material fumes and air and a second gas $G_2$ consisting of exhaust gases, the discharge device 10 may be used to discharge any other types of gases and/or additional gas flows from the vehicle 1.

Referring now to FIGS. 2 and 3, the discharge device body 12 is preferably connectable with an upper wall 6*a* of the tractor frame 6 such that the two inlets 18 and 20 are disposed within the interior 6*b* of the frame 6 and the outlet 22 is spaced vertically above, preferably by a substantial distance (not indicated), the upper wall 6*a*. Preferably, the discharge device 10 further includes a generally rectangular mounting plate 60 disposed about the first tubular portion 14 of the body 12 and having a central opening 62 through which extends the first, outer tubular portion or member 14. The mounting plate 60 is attached to the upper, horizontal frame wall 6*a* by appropriate means, such as by threaded fasteners, rivets or weldment material, to connect the discharge body 12 with the vehicle 1. Although the body 12 is preferably connected with the upper horizontal wall 6*a* by the mounting plate 60, the body 12 may be connected with the frame 6 by any other appropriate means, such as by a circular flange or by merely being disposed through a frame opening so as to be retained by a friction or interference fit, and/or may be mounted to any other appropriate location on the vehicle 1, such as for example, extending from a side or rear vertical frame wall (neither shown).

Still referring to FIGS. 2 and 3, the discharge body 12 preferably has a central, generally vertical axis 13, the outlet being spaced apart from each of the two inlets 18 and 20, preferably by a substantial distance (not indicated), along the vertical axis 13. Furthermore, a generally horizontal bend or hinge axis 15 extends generally perpendicularly with respect to the vertical axis 13 and is located between the outlet 22 and the two inlets 18 and 20. The body 12 is configured to bend about the hinge axis 15 such that the outlet 22 is movable in directions generally toward and away from the upper wall 6*a*, and thus the two inlets 18 and 20, which enables the overall height of the discharge device 10 to be reduced when the paving vehicle 1 is transported between job sites. Preferably, the body 12 is formed of a first or lower body portion 12*a* connected with the vehicle 1, a second or upper body portion 12*b* and a hinge 64 disposed between and pivotally or "hingedly" connecting the upper and lower body portions 12*a*, 12*b*, respectively. Alternatively, the body 12 may be formed of a plurality of overlapping sections or segments or fabricated of a flexible material, so that the body 12 is bendable about the horizontal axis 15, as discussed above. However, although it is preferred to construct the body 12 to be pivotable (or bendable) about the hinge axis 15, for reasons above, the body 12 may be appropriately formed so as to be generally rigid or unbendable, if desired.

Figure 4:
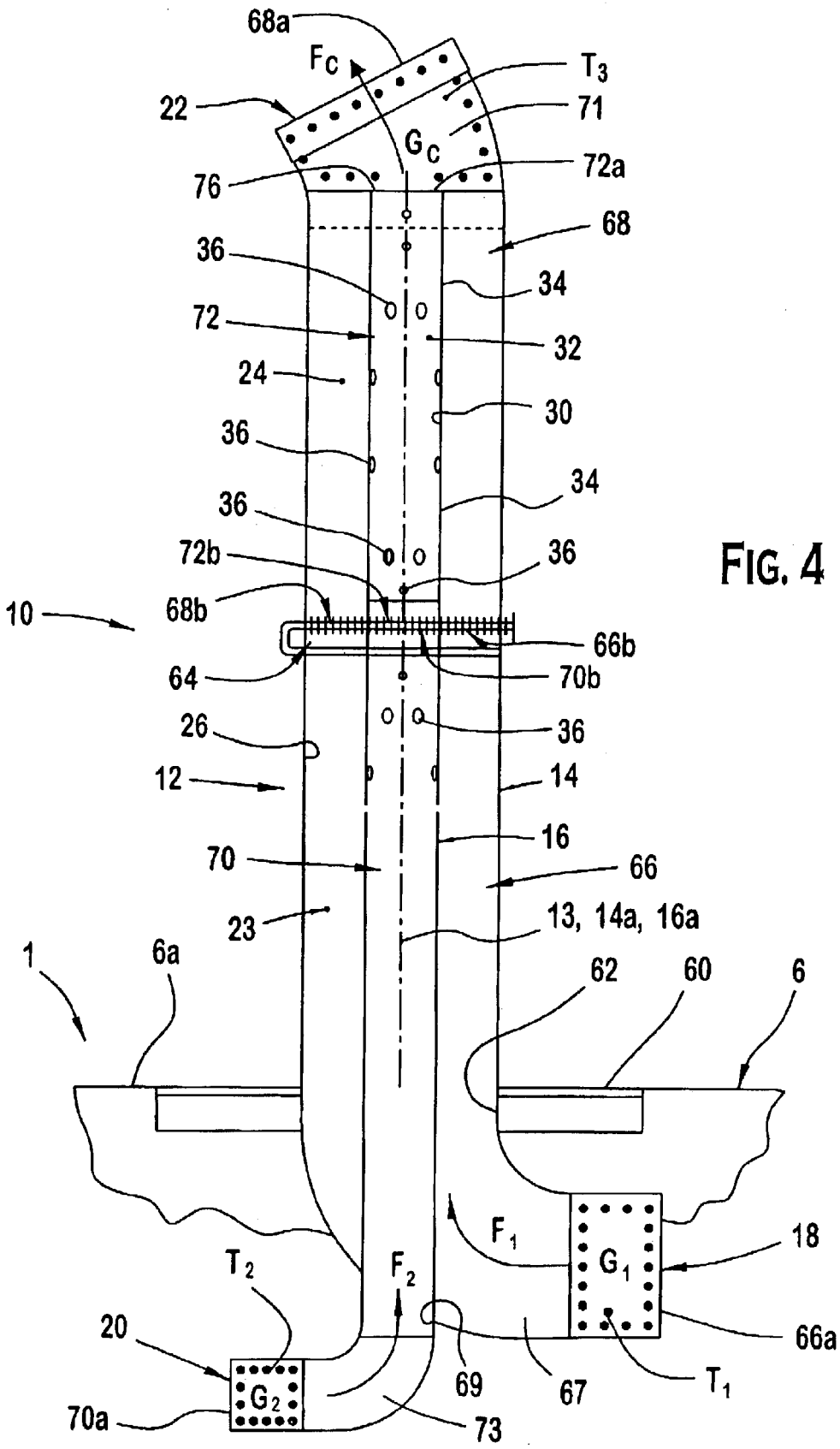
FIG. 4 is an enlarged, partly broken-away side elevational view of the gas discharge device.

Referring particularly to FIG. 4, the elongated body 12 most preferably includes each one of the first, outer tubular member 14 and the second, inner tubular member 16 (as discussed above) being formed of lower and upper tube halves 66, 68 and 70, 72, respectively. More specifically, the outer tubular portion or member 14 is preferably generally circular, i.e., has generally circular cross-sections in planes extending perpendicular to the central axis 13 (see FIG. 6), and includes the lower tube half 66 and the upper tube half 68. The lower tube half 66 is attached to the tractor frame upper wall 6*a* by the mounting plate 60 and has a curved lower portion 67 terminating in an outer open tube end 66*a*, which provides the first inlet 18, and an assembly opening 69 through which extends the second member 16, as described below. The lower tube half 66 further has an inner open end 66*b* about which is disposed a first member 65A (FIG. 2) of the hinge 64, as discussed in further detail below. Further, the upper tube half 68 has an inner open tube end 68*b* disposed proximal to the lower tube half inner end 66*b* and about which is disposed a second hinge member 65B (FIG. 2), as discussed below. The upper tube half 68 also has an upper curved portion 71 which terminates in an outer open tube end 68*a*, which provides the device outlet 22, and is configured to direct the combined gas flow $F_C$ forwardly with respect to the tractor 4, and therefore away from the screed 5 and the operator station (not indicated) where the human paver operators are located during a paving operation.

Still referring to FIG. 4, the inner tubular portion or member 16 is preferably generally circular, i.e., has generally circular cross-sections in planes extending perpendicular to the central axis 13 (see FIG. 6), and includes the lower tube half 70 and the upper tube half 72. The lower tube half 70 extends through the assembly opening 69 of the first tubular member 16 such that the two lower tube portions 66, 70 are generally coaxially disposed about the central axis 13 of the body 12. Further, the lower tube half 70 has a curved lower portion 73 terminating in an outer open tube end 70*a*, which provides the second inlet 20, and an inner open tube end 70*b* disposed within the inner tube end 66*b* of the first member lower tube half 66. Furthermore, the upper tube half 72 has a inner open tube end 72*b* disposed within the inner tube end 68*b* of the first member upper tube half 68 and proximal to the lower tube half inner end 70*b*. Also, the upper tube half 72 has an outer closed tube end 72*a*, specifically enclosed by a radially-extending circular end plate or cap 76 disposed within the tube end 72*b*, which is configured to redirect or "deflect" a portion of the second gas flow $F_2$ in a downward direction back along the central axis 13, as discussed in further detail below.

Figure 5:
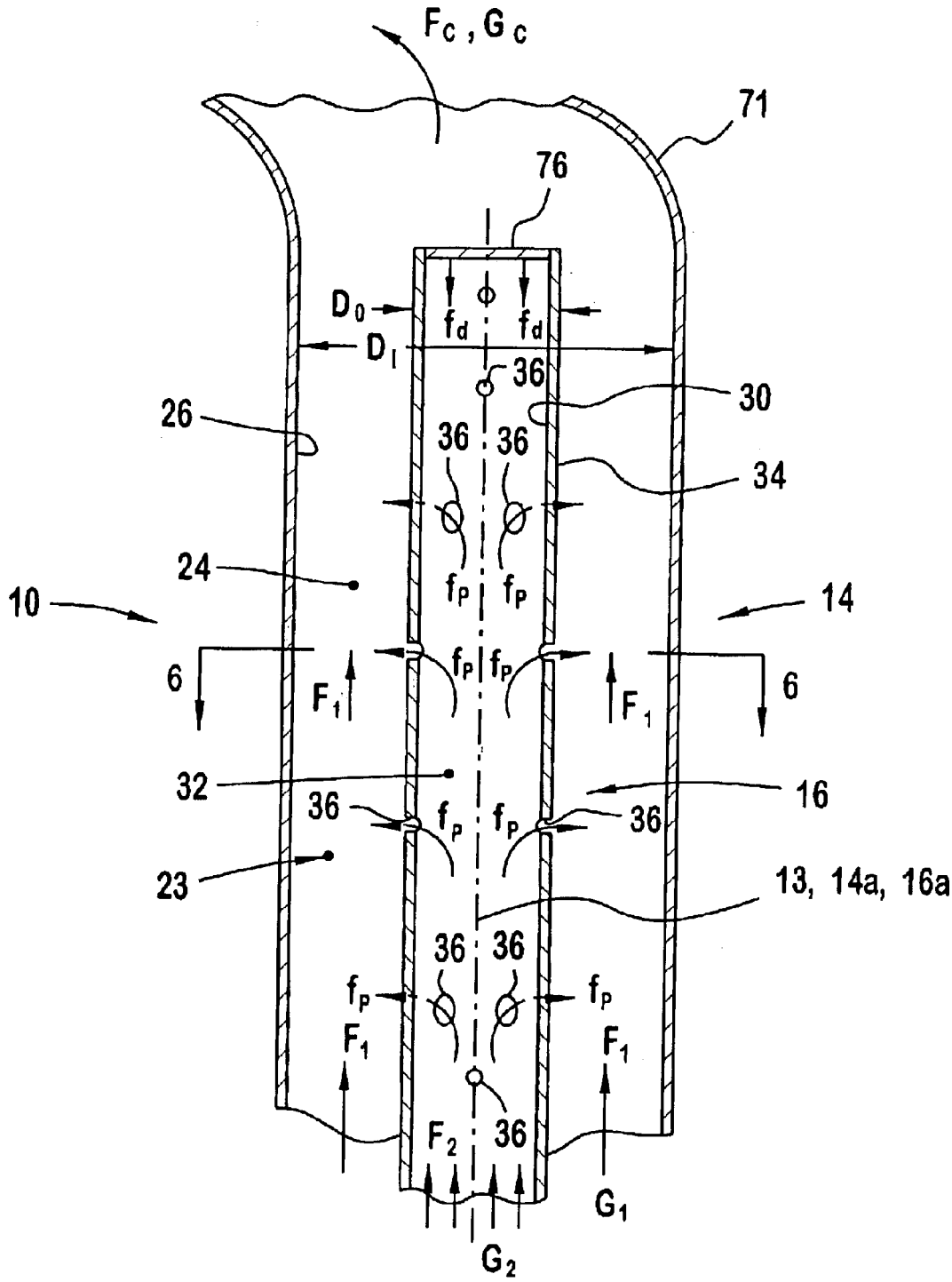
FIG. 5 is a greatly enlarged, broken-away view of the gas discharge device, depicting the flow and mixing of two gases within the device.
Figure 6:
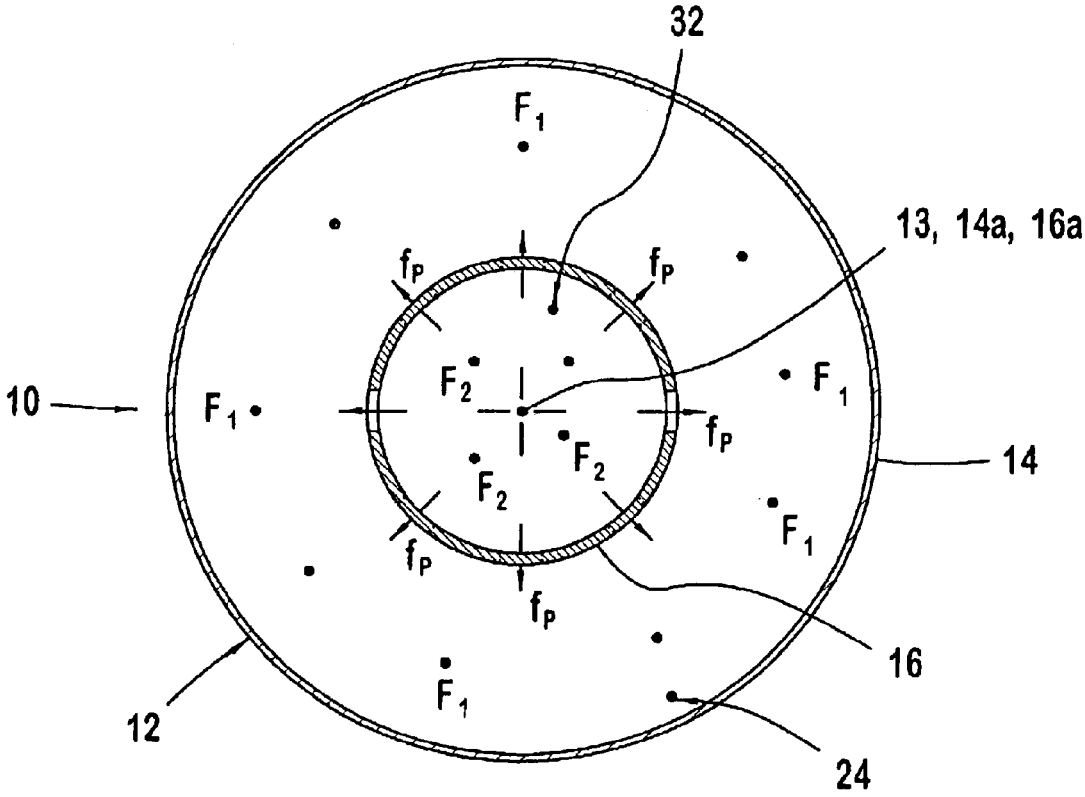
FIG. 6 is a view through line 6—6 of FIG. 5.

Referring to FIGS. 5 and 6, the second or inner tubular member 16 is sized having an outside diameter $D_O$ that is substantially lesser than an inside diameter $D_I$ of the first, outer tubular member 14. Thus, the mixing chamber 24 is provided by an annular portion of the interior space 23 extending axially along the upper portion of the second member 16 where the injection ports 36 are located. Furthermore, the axial length (not indicated) of the inner tubular member 16 is lesser than the axial length of the outer tubular member 14, such that the upper end 72*a* of the inner tubular member 16 is located at or below the lower end 71*a* of the upper curved portion 71 of the outer tubular member 14.

Still referring to FIGS. 5 and 6, the injection ports 36 of the second tubular member 16 are preferably spaced apart from each other port 36 both axially along and radially about the second member central axis 16*a*, and thus also the collinear body central axis 13. Most preferably, the plurality of injection ports 36 are arranged along a pair of spiral lines (not indicated) that extend in a double helix pattern about and along the axis 13. Such arrangement of the injection ports 36 is intended to promote turbulence within the mixing chamber 24 since the port arrangement results in separate portions $f_p$ of the second gas flow $F_2$ being injected into the first gas flow $F_1$ at various spaced apart locations, for reasons discussed in detail below. However, the injection ports 36 may be arranged in the second tubular member 16 in any appropriate manner, such as for example in a plurality of axial lines and/or circumferential rows, since any separation or dissection of the second gas flow $F_2$ into separate flow portions $f_p$ will generate at least some gas turbulence within the mixing chamber 24 for reducing pressure pulsation within the combined gas flow $F_C$, as discussed in further detail below.

Referring now to FIGS. 2 and 3, the first and second hinge members 65A, 65B, respectively, of the hinge 64 are each preferably formed as a generally rectangular plate 77 having a central opening 79. Preferably, the lower plate 77 has a pair of spaced apart cylindrical bearing portions 81 along one edge 77*a* and the upper plate has a single, centrally located bearing portion 81 along a proximal edge 77*a* and disposed between the two bearings of the lower plate. The hinge 64 preferably further includes a pin 83 extending the three bearing portions 81 so as to pivotally connect the upper and lower hinge plates 77, and thereby the upper and lower body halves 12*a*, 12*b* of the discharge body 12. Further, a spring 85 is preferably disposed about the pin 83 and/or bearings 81 so as to bias the two body halves toward a first, operational position (as depicted in the drawing figures). The hinge 64 is configured to enable the body to be foldable or pivotable about the hinge axis 15 so that the upper body half 12*b* is rotatably displaceable to a travel position, at which the upper body half 12*b* extends along the lower body half 12*a* and the outlet 22 is disposed proximal to the frame upper wall 6*a*. Although the above hinge structure is presently preferred, the hinge 64 may be constructed in any appropriate manner, or the body 12 may be formed without any hinge, as discussed above, as the scope of the present invention is in no manner limited by the hinge 64.

Referring to FIG. 3, the discharge body 12 preferably further includes three spacers or centralizers 75 (only two shown) each disposed about the second tubular member 16 and extending between the second member outer surface 34 and the first member inner surface 26. The three centralizers 75 are configured to position the second member 16 coaxially within the first tubular member 14 and centered about the body central axis 13. Further, the centralizers 75 are constructed such that the first gas flow $F_1$ are and/or the combined gas flow $F_C$ is able to flow through the centralizers 75 without any significant flow interference or impedance. Examples of such centralizer structures include a plate with a plurality of openings or a pair of inner and outer rings with a plurality of spokes extending therebetween (neither structure shown). Preferably, a first centralizer 75 is disposed about the lower tube half 70 proximal to the inner tube end 70*b*, such that the lower tube half 70 is coaxially positioned by both the first centralizer 75 and the assembly opening 69. Further, a second centralizer (not shown) is disposed proximal to the inner tube end 72*b* of the upper tube half 72 (i.e. within the upper hinge member 65B) and a third centralizer 75 is disposed proximal to the outer tube end 72*a*, the upper tube half 72 thereby being coaxially positioned by these two centralizers 75.

Although the elongated discharge body 12 is preferably formed as described above, the body 12 may be formed in any other appropriate manner that enables the two gases $G_1$ and $G_2$, or gas flows $F_1$ and $F_2$, to combine and reduce pressure pulsation of one of the gases/gas flows (i.e., of second gas $G_2$) as discussed above and in further detail below. For example, the two tubular portions/members 14 and 16 may be formed with ovular, rectangular or complex-shaped cross-sections, may be arranged such that the inner member 16 is disposed toward one side of the axis 13 rather than coaxial with the outer tubular member 14, and/or may be constructed as one-piece members (i.e., as opposed to upper and lower portions)(none shown). Further for example, the body 12 may be formed of a solid member, such as a cylindrical bar, having at least two flow passages each with an inlet connectable with one of two separate gas sources $S_1$, $S_2$, an internal mixing chamber, an outlet from the chamber and passages connecting the flow passages with the chamber so as mix the gases in a manner to reduce the pressure pulsation level in at least one of the gases (not shown).

As yet another example, the body 12 may include one or more other inlets fluidly connected with the outer tubular member 14 and/or one or more other inner tubular members disposed within the outer tubular member 14 and formed generally similar to the inner tubular member 16, with each additional inlet of the outer tube 14 or the inlet of each additional inner tubular member being fluidly connectable with another source of gas/gas flow (not shown). As such, the discharge device 10 may alternatively combine and discharge three or more separate gases or gas flows, while functioning to reduce the pressure pulsation magnitude of at least one of these gases. The scope of the present invention encompasses these and all other appropriate structures of the discharge body 12 that enables the discharge device 10 to function generally as described herein.

Referring to FIGS. 4–6, in use, the gas discharge device 10 of the present invention basically functions in the following manner. With the preferred structure and application as described above, the material fumes/air $G_1$ forming the first gas flow $F_1$ enter the first inlet 18 and flow axially upwardly through the lower portion of the interior space 23 between the first member inner surface 26 and the second member outer surface 34, then enters the interior space upper portion providing the mixing chamber 24. At the same time, the engine exhaust gas $G_2$ forming the second gas flow $F_2$ enters the inner tubular member 16 through the second inlet 20, flows axially upwardly along the central axis 13 and enters the interior transition chamber 32. The second gas flow $F_2$ enters the interior chamber 32 at a generally higher pressure than the first gas flow $F_1$ flowing through the mixing chamber 24, such that the second gas $G_2$/gas flow $F_2$ is subsequently "injected" into the first gas $G_1$/gas flow $F_1$ within the mixing chamber 24.

More specifically, a plurality of separate flow portions $f_P$ of the second gas flow $F_2$ each pass forcefully through a separate one of the injection ports 36 and combine with the first gas flow $F_1$ at a plurality of different locations within the mixing chamber 24. Further, the second gas flow portions $f_p$ are directed by the injection ports 36 to flow generally radially outwardly (i.e., away from the axis 13) into the mixing chamber 24 such that the second gas flow $F_2$ "collides" with the axially upwardly flowing first gas flow $F_1$ in the manner of a cross-flow. The effects of injecting a plurality of separate second gas flow portions $f_p$ into the first gas $G_1$ at a plurality of axially and circumferentially spaced apart locations and of colliding the two gas flows $F_1$, $F_2$ in a cross-flow cause the combined gas flow $F_C$ to have a relatively high level of turbulence. Such turbulence promotes destructive interference between the pressure pulsations of various portions of the combined gas flow $F_C$, i.e., portions of the combined gas $G_C$ at various locations within the mixing chamber 24, which thereby results in the combined gas $G_C$/gas flow $F_C$ having a net level or magnitude of pressure pulsation that is lesser or reduced in comparison with the pressure pulsation magnitude of the second gas $G_2$/gas flow $F_2$ when it enters the inner tubular member 16.

In addition, the magnitude of pressure pulsation within the second gas flow $F_2$ is reduced from the pulsation magnitude at the second inlet 20, prior to combining with the first gas flow $F_1$, by the following effect caused by the flow pattern of the second gas flow $F_2$. As the second gas flow $F_2$ travels axially upwardly through the transition chamber 32, certain portions $f_d$ of the second gas flow $F_2$ initially flow by (i.e., without entering) all of the ports 36, and then contact and deflect back off of the end cap 76. These deflected flow portions $f_d$ subsequently flow axially downwardly to collide "head on" with the main portion of the second gas flow $F_2$ flowing axially upwardly, thereby generating destructive interfering turbulence within the second gas flow $F_2$ itself. Furthermore, the structure of the discharge body 12, specifically having the ported inner tubular member 16 disposed within the outer tubular member 14, also provides reduction or attenuation of the pressure pulsation magnitude of the second gas $G_2$ due to the mixing chamber 24 also functioning as a reactive expansion or resonator chamber, in a manner generally known in the art of muffler or silencer devices.

After the two gases $G_1$ and $G_2$ are combined in the mixing chamber 24, the combined gas $G_C$/gas flow $F_C$ exits the discharge device 10 through the outlet 22 so as to be discharged into ambient A. Due to the effects described above, the combined gas Gc has a pressure pulsation magnitude that is substantially lesser than the pressure pulsation magnitude of the second gas $G_2$ entering the device 10, such that the discharge device 10 provides the benefit of generating a lesser sound level compared to the sound level resulting were the exhaust gases $G_2$ discharged from the pipe 54 directly to ambient air A. In addition, by combining the relatively "hot" exhaust gas $G_2$ with the "cooler" fume/air gas $G_1$, the combined gas $G_C$ has a significantly lesser temperature $T_3$ than the exhaust gas temperature $T_2$ at the second inlet 20. As such, the discharge device 10 also provides the benefit of reducing thermal energy output or "thermal pollution" compared to directly discharging the exhaust gases $G_2$ from the exhaust pipe 54 or even through known muffler/silencer devices (none shown). Further, the gas discharge device 10 of the present invention enables two different gases $G_1$ and $G_2$ to be discharged from the paving vehicle 1 from a single "stack" as opposed to multiple stacks as would otherwise be required, thereby reducing the number of vehicle components. Furthermore, by having a foldable body 12, the single discharge device 10 may be readily and conveniently arranged in a travel (i.e., folded) position during transportation of the vehicle 1 between different job sites.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A gas discharge device for discharging first and second gases from a paving vehicle to ambient air, the first gas flowing from a first gas source and the second gas flowing from a second gas source, the second gas having pressure pulsation of a first magnitude, the paving vehicle having fume removal system configured to evacuate paving material fumes from a location one of within the vehicle and proximal to the vehicle, the fume removal system having an outlet portion providing the first gas source, the first gas including paving material fumes and air, and an engine having an exhaust flow line providing the second gas source, the second gas including engine exhaust gases, the discharge device comprising:

an elongated body connected to the vehicle and having a first inlet fluidly connected to the first gas source, a second inlet fluidly connected to the second gas source, an outlet fluidly communicable with ambient air, and an interior mixing chamber, the first and second inlets each being fluidly communicable with the mixing chamber such that the first and second gases flow into the mixing chamber when the first inlet is connected with the first gas source and the second inlet is connected with the second gas source, the body being configured to combine the first and second gases within the mixing chamber so as to form a combined gas having pressure pulsation of a second magnitude, the second pulsation magnitude being substantially lesser than the first pulsation magnitude, and to discharge the combined gas through the outlet to ambient air.

2. The discharge device as recited in claim 1 wherein the first gas flows from the first gas source at a pressure substantially greater than ambient air pressure.

3. The discharge device as recited in claim 1 wherein the second pulsation magnitude is about zero such that the combined gas has a generally constant pressure.

4. The discharge device as recited in claim 1 wherein the first gas is generally at a first temperature, the second gas is generally at a second temperature, the second temperature being substantially greater than the first temperature, and the combined gas is generally at a third temperature, the third temperature being substantially lesser than the second temperature.

5. The discharge device as recited in claim 1 wherein the body includes:

a first tubular portion including the first inlet and the outlet; and a second tubular portion disposed at least partially within the first tubular portion such that the mixing chamber is defined between the two tubular portions, the second portion including the second inlet, an interior chamber and a plurality of ports extending between the interior chamber and the mixing chamber.

6. The discharge device as recited in claim 5 wherein:

the first tubular portion further includes an inner surface bounding an interior space; and the second tubular portion includes an outer surface, the outer surface being spaced from and facing generally toward the inner surface of the first member such that a portion of the interior space between the first member inner surface and the second member outer surface provides the mixing chamber, and an inner surface bounding the interior chamber, each port extending between the inner and outer surfaces of the second tubular portion.

7. The discharge device as recited in claim 5 wherein the second tubular portion has a longitudinal central axis and the ports are spaced part axially and radially with respect to the central axis.

8. The discharge device as recited in claim 5 wherein the second tubular portion further has a first end, the first end having an opening providing the second portion inlet, and an opposing, enclosed second end, the ports being disposed generally between the first and second ends.

9. The discharge device as recited in claim 5 wherein the first and second tubular portions each include a longitudinal central axis, the two axes being generally collinear, and generally circular cross sections within planes extending perpendicularly with respect to the collinear axes such that the mixing chamber is generally annular.

10. The discharge device as recited in claim 5 wherein:

the first tubular portion includes a lower section providing the first inlet and an upper section pivotally connected with the lower section and providing the outlet; and the second tubular portion includes a lower section disposed at least partially within the first tubular portion lower section, the second tubular portion lower section providing the second inlet, and an upper section pivotally connected with the second tubular portion lower section and disposed within the first tubular member upper section.

11. The discharge device as recited in claim 1 wherein the elongated body further includes a lower portion connectable with the vehicle and including the two inlets, an upper portion including the outlet and a hinge disposed between and pivotally connecting the upper and lower body portions.

12. The discharge device as recited in claim 1 wherein the elongated body further includes a central, generally vertical axis, the outlet being spaced vertically apart from each one of the two inlets generally along the vertical axis, and a generally horizontal axis extending generally perpendicularly with respect to the vertical axis and disposed generally between the outlet and the two inlets, the body being configured to bend about the axis such that the outlet is alternatively movable in vertical directions generally toward and generally away from the two inlets.

13. A gas discharge device for discharging paving material fumes and engine exhaust gases from a paving vehicle to ambient air, the vehicle having an engine and a fume removal system, the exhaust gases having a substantial level of pressure pulsation, the discharge device comprising:

a first tubular member having an inner surface bounding an interior space, an inlet fluidly connected to the fume removal system and an outlet fluidly communicable with ambient air; and a second tubular member disposed at least partially within the first member, the second member having an inner surface bounding an interior chamber, an inlet extending into the interior chamber and fluidly connected to the engine, an outer surface disposed concentrically within the inner surface of the first tubular member such that the first member inner surface and second member outer surface define an annular mixing chamber, and a plurality of ports, each port extending between the inner and outer surfaces of the second member and establishing fluid communication between the second member interior chamber and the mixing chamber such that the exhaust gas flow flows into the mixing chamber and combines with the fume gas flow, a combined gas flow exiting to ambient air through the first member outlet and having a level of pressure pulsation that is lesser than the pulsation level of the exhaust gases flowing into the interior chamber through the second member inlet.

14. A gas discharge device for discharging first and second gases from a paving vehicle to ambient air, the first gas flowing from a first gas source and the second gas flowing from a second gas source, the second gas having pressure pulsation of a first magnitude, the discharge device comprising:

an elongated body connected to the vehicle and having a first inlet fluidly connected to the first gas source, a second inlet fluidly connected to the second gas source, an outlet fluidly communicable with ambient air, and an interior mixing chamber, the first and second inlets each being fluidly communicable with the mixing chamber such that the first and second gases flow into the mixing chamber when the first inlet is connected with the first gas source and the second inlet is connected with the second gas source, the body being configured to combine the first and second gases within the mixing chamber so as to form a combined gas having pressure pulsation of a second magnitude, the second pulsation magnitude being substantially lesser than the first pulsation magnitude, and to discharge the combined gas through the outlet to ambient air; and wherein the body includes a first tubular portion including the first inlet and the outlet and a second tubular portion disposed at least partially within the first portion such that the mixing chamber is defined between the two tubular portions, the second portion including the second inlet, an interior chamber and a plurality of ports extending between the interior chamber and the mixing chamber.

* * * * *